United States Patent [19]

Low et al.

[11] 4,279,084

[45] Jul. 21, 1981

[54] SNOWPLOW BLADE LIFT MOUNT ASSEMBLY

[75] Inventors: William H. Low, Chardon; Vernon L. Hetrick, North Olmsted; Paul McCoy, Lyndhurst, all of Ohio

[73] Assignee: Meyer Products, Inc., Cleveland, Ohio

[21] Appl. No.: 94,818

[22] Filed: Nov. 15, 1979

[51] Int. Cl.[3] ..... E01H 5/04

[52] U.S. Cl. ..... 37/42 R; 172/272

[58] Field of Search ..... 37/41, 42 R, 42 VL, 37/50, 43 R; 172/275, 272; 280/479 R, 479 A, 481, 461 R

[56] References Cited

U.S. PATENT DOCUMENTS

| | | | |
|---|---|---|---|
| 2,091,343 | 8/1937 | Soule et al. | 37/42 R |
| 2,094,515 | 9/1937 | Abbe | 37/42 R |
| 2,242,826 | 5/1941 | Keeler | 37/42 R |
| 2,667,708 | 2/1954 | Gjesdahl | 37/42 R |
| 3,005,511 | 10/1961 | Riedy | 37/42 R X |
| 3,104,893 | 9/1963 | Torrey | 37/42 R |
| 3,175,313 | 3/1965 | Renahan | 37/42 |
| 3,214,138 | 9/1965 | Jocher et al. | 37/42 X |
| 3,376,946 | 4/1968 | Paulson | 37/42 X |
| 3,400,475 | 9/1968 | Peitl | 37/42 |
| 3,410,008 | 11/1968 | Standfuss | 37/42 |
| 3,456,369 | 7/1969 | Leposky | 37/42 R |
| 3,484,962 | 12/1969 | Klapprodt | 37/43 |
| 3,643,976 | 2/1972 | Haupt | 172/272 X |
| 3,853,335 | 12/1974 | Heckenkamp | 172/272 X |
| 3,987,562 | 10/1976 | Deen et al. | 37/42 R |

FOREIGN PATENT DOCUMENTS

| | | | |
|---|---|---|---|
| 128695 | 6/1950 | Sweden | 37/42 R |
| 264534 | 10/1949 | Switzerland | 37/42 R |

*Primary Examiner*—E. H. Eickholt

*Attorney, Agent, or Firm*—Meyer, Tilberry & Body

[57] ABSTRACT

A lift mount assembly is provided for a plow blade unit mounted on the front of a vehicle having longitudinally extending frame members and a laterally extending bumper at the front ends of the frame members. The assembly includes a supporting portion comprised of mounting plates attached to the front ends of the frame members behind the bumper, and laterally extending upper and lower tubular cross members between the mounting plates. The supporting portion further includes a pair of lift arm mounting members on the upper cross member extending to a point just above the bumper, and a bracket on the lower cross member providing a forwardly open socket just below the bumper. The lift mount assembly also includes a lift arm unit comprising a lift arm pivotally interconnected with the lift arm mounting members and extending forwardly over and closely adjacent the bumper, a lift cylinder support arm received in the socket and extending forwardly beneath and closely adjacent the bumper, and a generally vertically extending lift cylinder between the support arm and lift arm and closely adjacent the front of the vehicle bumper. The lift arm unit is adapted to be quickly removed from or attached to the supporting portion by means of quick hitch-type pin connections between the lift arm and lift arm mounting members and between the support arm and bracket.

33 Claims, 9 Drawing Figures

SNOWPLOW BLADE LIFT MOUNT ASSEMBLY

BACKGROUND OF THE INVENTION

This invention relates to the art of snowplows mountable on automotive vehicles and, more particularly, to plow blade lift mount assemblies for snowplow blade units.

It is of course well known that service station owners, farmers and other individuals use commercially available vehicles such as pick-up trucks as snowplows. In this respect, such a vehicle is provided with a plow blade unit support structure which is mounted on and beneath the vehicle frame rearwardly of the front of the vehicle, and a plow blade lift mount assembly which is mounted on the front end of the vehicle and, for example, on the bumper thereof or a special cross member between the front ends of the vehicle frame members. The plow blade unit generally includes a frame assembly supporting a plow blade forwardly of the vehicle and having an inner end adapted to be releasably hitched to the support structure beneath the vehicle. The blade unit frame is interconnected adjacent the front of the vehicle with a vertically pivotal lift arm of the lift mount assembly which is actuated such as by a hydraulic cylinder and ram to achieve elevating and lowering of the plow blade relative to ground. Detachment of the plow blade unit advantageously enables use of the vehicle for personal and/or work oriented purposes other than snowplowing.

When such a plow blade unit is attached to a vehicle, the lift mount assembly serves primarily to elevate and support the plow blade above ground during transportation of the snowplow from one location to another as well as during a snowplow operation such as when the vehicle is moving backwards. When the blade is lowered to the ground in order to plow snow, the snowplowing forces are directed through the plow blade unit frame to the connection thereof with the vehicle frame. Thus, the maximum forces and stresses insofar as the lift mount assembly is concerned are applied thereto when the plow blade is elevated from ground. These forces and stresses result from the weight of the blade and the vertical bouncing of the blade during elevated transport thereof by the vehicle, which bouncing can transmit severe forces when the vehicle passes over a bump or a depression such as that resulting from a chuckhole in a street.

Lift mount assemblies heretofore provided for the foregoing purpose include one or more of a number of structural characteristics which are disadvantageous from the standpoint of weight, the magnitude and direction of forces applied to component parts thereof and to the vehicle on which they are mounted, aesthetics with respect to the vehicle, exposure to adverse environmental conditions and to potential physical damage during non-snowplow use of the vehicle, and cost from the standpoint of manufacture of the mount assembly and/or modification of the front of a vehicle to facilitate the attachment of the assembly thereto. More particularly with regard to such disadvantages, lift mount assemblies heretofore provided are mounted on the existing vehicle bumper, or on a special cross member between the vehicle frame members which either replaces or is provided in addition to the bumper, or are primarily mounted on one of the vehicle frame and bumper components and interconnected with the other by bracing. Generally, the lift arm mounting component or components of the lift mount assemblies extend vertically a considerable distance above the point of structural connection thereof with the vehicle and, most often, to a point at or just below the plane of the vehicle hood. Furthermore, the lift cylinder and ram components of the assembly are in most instances interconnected with the lift arm mounting member and the lift arm to provide an angular relationship therebetween which is disadvantageous from the standpoints of mechanical advantage and force application on the cylinder and ram components in connection with actuation of the lift cylinder to elevate and lower the plow blade. Examples of such arrangements are shown in Swiss Pat. No. 264,534 and U.S. Pat. Nos. 2,667,708 to Gjesdahl; 3,214,138 to Jocher et al; 3,401,008 to Standfuss; 3,456,369 to Leposky; and 3,987,562 to Dean et al.

It will be appreciated from the arrangements shown in the patents referred to above that, when the blades thereof are elevated, the vertically long lift arm mounting members cause considerable torsional stress at the points of connection between the mounting members and the vehicles as a result of the weight of the corresponding plow blade unit. Such torsional forces necessitate structurally heavy mounting members and supports therefor, and special structural interconnections therebetween such as multiple weldments in an effort to minimize damage and/or bending or breakage of the mounting member and/or its support components. Accordingly, the lift mount assemblies are either structurally complex, heavy, expensive to produce and/or cumbersome to install. It will be further appreciated from such prior art, and especially with respect to a construction such as that shown in the Swiss patent in which the lift arm mounting member structure and lift cylinder are behind a cross member at the front of the vehicle frame, that previous lift mount assemblies require a special construction or modification of the front end of the vehicle to accommodate the assembly, thus further adding to the cost and detracting from the aesthetic appearance of the vehicle front. It will be appreciated that any required modification of the vehicle front, such as to replace the original or standard bumper thereof with a special cross member, both increases the cost and detracts aesthetically. It will likewise be appreciated that any mounting on the standard bumper of a vehicle not only detracts from the aesthetic value, but more importantly, subjects the bumper to distortion and damage as a result of the forces applied thereto when the plow blade is transported in an elevated position.

With further regard to lift mount assemblies heretofore provided, all of the component parts thereof are intended to remain on the vehicle when the plow blade unit is removed therefrom. This is undesirable from the standpoint of the weight imposed on the front axle of the vehicle, especially in view of Federal Government restrictions on front axle loading. Moreover, such prior arrangements provide for at least the lift arm and a portion of the lift cylinder unit to project a considerable distance forwardly of the vehicle bumper or the cross member replacing the bumper. Such projecting parts are thus subject to damage or destruction, together with the lift arm mounting member and vehicle bumper and/or frame members should the vehicle impact against an object such as another vehicle. Moreover, these component parts are exposed year round to adverse weather conditions, thus increasing maintenance and replacement costs. Further, the component parts are of course visible and thus detract from the aesthetic appearance of the front of the vehicle when it is not being used as a snowplow. While arrangements such as those shown in the Jocker et al and Dean et al patents referred to above provide for collapsing the lift cylinder and lift arm into a stored relationship to reduce the extent of projection of the lift mount assembly forwardly of the vehicle during non-snowplowing use thereof, such stored relationship does not eliminate exposure of the component parts to environmental conditions, nor does it eliminate potential damage thereto should the vehicle impact with another object, or reduce the weight on the front axle of the vehicle. Moreover, such storage does little to improve the aesthetic appearance of the front of the vehicle relative to that which exists with the lift arm and cylinder in their use positions. A further problem in connection with such lift mount assemblies is theft, wherby leaving the lift arm and lift cylinder components on the vehicle whether stored or not, subjects the owner of the vehicle to a potential aggravation and financial loss resulting from such theft.

With regard to the aesthetic value of the vehicle mentioned hereinabove, it will be appreciated that the owner of such a vehicle often uses the same as a personal or family conveyance, whereby aesthetics are of considerable importance. A special cross member at the front of the vehicle to replace the standard bumper in order to support a lift mount assembly is thus obviously undesirable, as is the mounting of the lift mount assembly either directly or indirectly on the bumper. The latter not only detracts aesthetically but also subjects the bumper to damage or distortion which would further detract from the aesthetic value thereof. Still further, any special modification of a commercially available vehicle which is required to install a lift mount assembly is undesirable both from the standpoint of cost and aesthetics.

SUMMARY OF THE INVENTION

The present invention advantageously provides a plow blade lift mount assembly mountable on the front of a vehicle and which is structured and associated with the vehicle frame in a manner which minimizes or overcomes the disadvantages, including those enumerated above, with respect to previously available lift mount assemblies. In this respect, a lift mount assembly according to the present invention is structurally simple and light in weight, thus enabling a savings in cost while facilitating the installation procedure and reducing the weight imposed on the front axle of the vehicle during non-snowplowing use thereof. The assembly is completely structurally independent of the vehicle bumper, and is mountable on the vehicle without replacing the original or existing bumper. Further, the structure of the lift mount assembly and the structural interrelationship thereof with the vehicle provides for the lift arm to be pivotal about an axis close to the vehicle bumper, thus to reduce torsional forces on the supporting members of the assembly and the vehicle frame to which the support members are attached. Still further, a lift mount assembly according to the present invention advantageously enables a quick release and removal of the lift arm unit including the lift arm and lift arm actuator from the supporting portion of the assembly, whereby only the supporting portion need remain on the vehicle during non-snowplowing use of the vehicle. Accordingly, the components of the lift arm unit can be stored and thus protected from adverse environmental conditions or potential damage by impact of the vehicle with another object during non-snowplowing use thereof. Still further, the supporting structure for the lift arm unit is constructed and associated with the vehicle so as to advantageously minimize both the visibility of the supporting structure and the projection of component parts thereof forwardly of the vehicle when the lift arm unit is removed, thus to promote the intended aesthetic appearance of the front of the vehicle. At the same time, the supporting structure and lift arm unit when assembled cooperatively provide good mechanical advantage with respect to pivotal displacement of the lift arm by the lift arm actuator and minimize wear with respect to the component parts of the actuator.

The mounting of the lift mount assembly independent of the vehicle bumper provides for the forces and stresses imposed on the assembly when a plow blade unit is elevated to be transmitted through the supporting portion of the assembly to the vehicle frame, thus avoiding any distortion whatsoever of the bumper member or any disfiguring thereof by attachment of component parts of the assembly thereto. Furthermore, the supporting portion of the assembly is adapted to be mounted laterally between the front ends of the vehicle frame members and between the bumper and vehicle body without requiring a special construction or major modification of the bumper and body to accommodate the supporting portion. The structure and mounting of the supporting portion also enables a major portion thereof to be hidden by the bumper, and both of these features promote aesthetics of the vehicle with respect to non-snowplow use thereof. Preferably, the lift arm and lift arm actuator are structured for interengagement with the supporting portion of the assembly such that the lift arm actuator is disposed generally vertically and closely adjacent to the front of the bumper and the lift arm extends forwardly over and closely adjacent the bumper. In accordance with a preferred embodiment, the lift arm actuator is connected to the outer end of a support arm received in an inclined socket provided on the supporting portion of the assembly beneath the bumper. Thus, the assembly in its entirety closely surrounds the bumper. The vertical disposition of the actuator optimizes mechanical advantage in connection with its function to pivotally displace the lift arm and minimizes wear between the component parts of the actuator. Removability of the lift arm unit in accordance with the preferred embodiment is enabled by providing a quick-release hitch-type pivot pin connection between the lift arm and supporting portion of the assembly and a similar quick-release hitch-type pin connection between the actuator support arm and the supporting portion. Thus, all that is necessary to remove the lift arm unit for storage during non-snowplow use of the vehicle, once the plow blade is detached, is to remove the two pins and disconnect power supply lines to the actuator. Additionally, the inclined disposition of the support arm socket advantageously serves to support the arm against displacement from the socket should the hitch pin for the arm come loose during a snowplowing operation.

In accordance with another aspect of the invention, a lighter weight assembly is promoted by a unique structure of the supporting portion which includes tubular cross members between mounting plates which are attached to the vehicle frame components. The cross members are disposed generally behind the bumper and define upper and lower cross members with which the lift arm and lift arm actuator are respectively interconnected. Structural integrity for the assembly under the weight of an elevated plow blade unit associated therewith is achieved by interconnecting the cross members with one another laterally inwardly of the mounting plates to restrain relative displacement therebetween transverse to the axes thereof.

In accordance with another aspect of the present invention, the quick-disconnect of a lift arm unit associated with a vehicle mounted supporting structure therefor is achieved by pivotally interconnecting the lift arm and the lower end of an extendable and retractable lift arm actuator with the supporting structure by means of corresponding quick-release pivot pin connections, and, by providing the power supply line or lines from the vehicle to the lift arm actuator with quick-connect separable couplings which are between the vehicle and actuator and thus readily accessible.

It is accordingly an outstanding object of the present invention to provide improvements in connection with plow blade lift mount assemblies mountable on the front end of a vehicle for elevating and lowering a plow blade unit mounted on the vehicle.

Another object is the provision of a lift mount assembly for the foregoing purpose which reduces stresses applied to the vehicle frame and supporting portion of the assembly under the load of a given plow blade when the latter is supported in elevation thereby.

A further object is the provision of a lift mount assembly of the foregoing character which enables quick-release and removal of the lift arm and lift arm actuator of the assembly from the supporting portion thereof during periods of non-snowplowing use of the vehicle.

Still another object is the provision of a lift mount assembly of the foregoing character which enables quick-release and removal and at the same time protects against unintentional separation of component parts from the supporting portion during snowplow use thereof.

Yet another object is the provision of a plow blade unit mount assembly associated with a vehicle frame completely independent of the vehicle bumper.

Yet a further object is the provision of a lift mount assembly of the foregoing character including a supporting portion behind the vehicle bumper, a lift arm pivotally connected to the supporting portion closely adjacent the top of the bumper and extending forwardly thereover, and a lift arm actuator disposed generally vertically close to the front of the bumper and interconnected with the lift arm and the lower portion of the supporting structure, whereby the assembly in its entirety surrounds the bumper independent of contact or connection therewith.

Still a further object is the provision of a lift mount assembly of the foregoing character in which the structure and location of the supporting portion relative to the bumper and vehicle body promotes the aesthetic value of the front end of the vehicle during non-snowplow use of the vehicle with the lift arm and lift arm actuator removed.

Another object is the provision of a lift mount assembly of the foregoing character which reduces the weight imposed on the front axle of the vehicle both during snowplowing and non-snowplowing use of the vehicle.

Yet another object is the provision of a lift mount assembly of the foregoing character in which the supporting portion is primarily disposed behind the vehicle bumper and minimizes or eliminates the projection of component parts forwardly of the front of the bumper.

Still a further object is the provision of a lift mount assembly which is of lighter weight construction than heretofore possible, which has structural integrity with respect to loads imposed thereon when supporting a given plow blade in elevation, which promotes the life of component parts of the assembly and minimizes maintenance and replacement cost with respect thereto by enabling removal thereof from a supporting portion of the assembly.

BRIEF DESCRIPTION OF THE DRAWINGS

The foregoing objects, and others, will in part be obvious and in part be pointed out more fully hereinafter in conjunction with the description of the accompanying drawings illustrating embodiments of the invention and in which.

DESCRIPTION OF PREFERRED EMBODIMENTS

Figure 1:
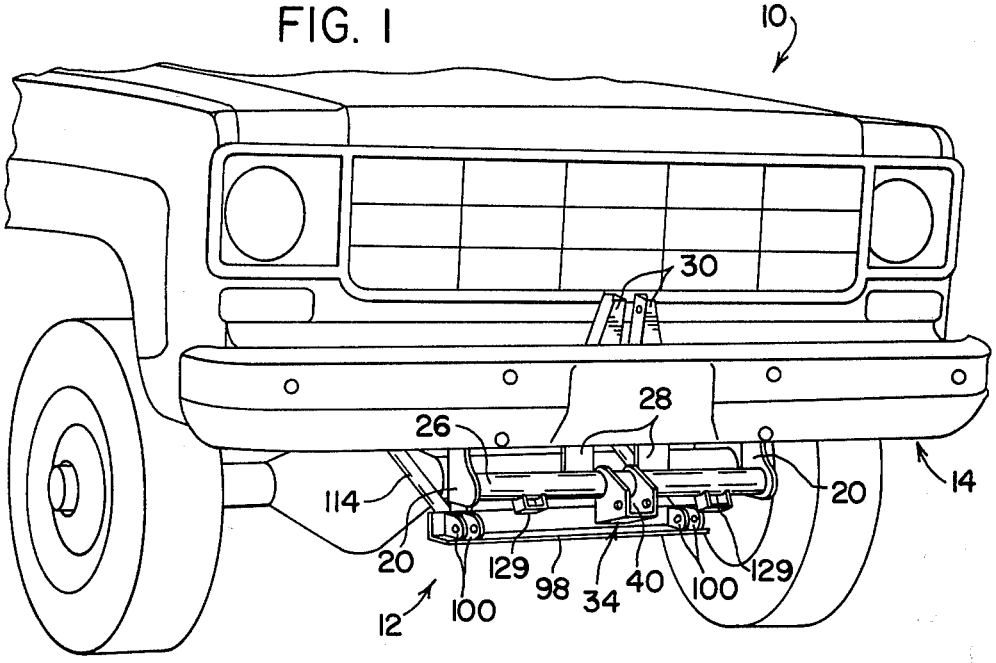
FIG. 1 is a perspective view of the front end of an automotive vehicle having the supporting portion of a lift mount assembly of the present invention mounted thereon.
Figure 2:
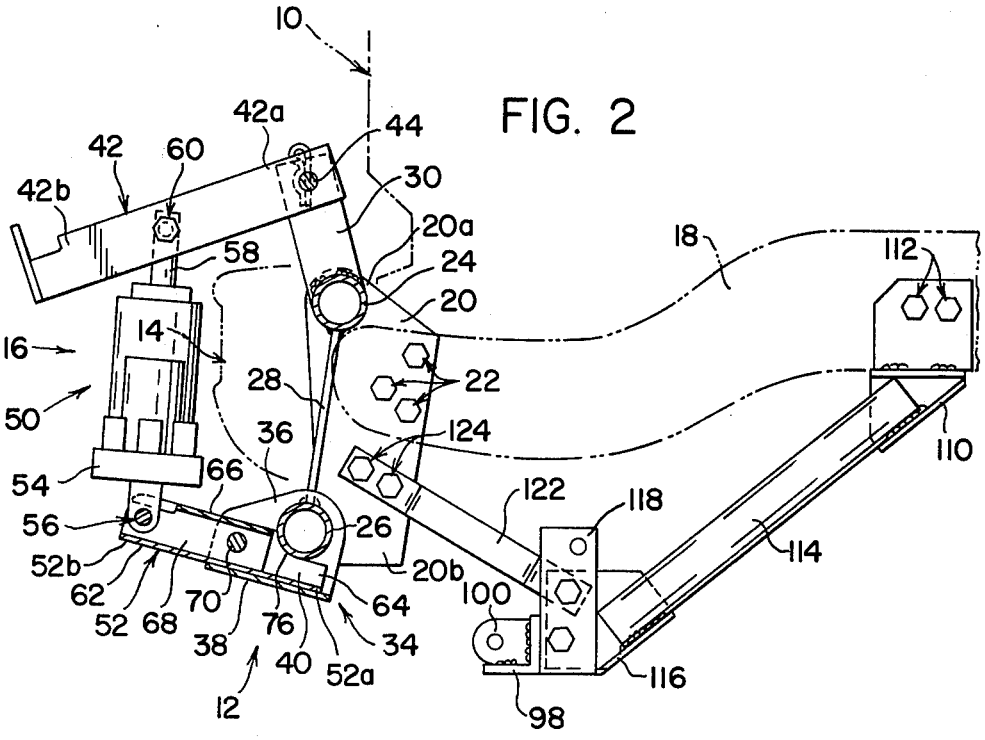
FIG. 2 is a cross-sectional side elevation view showing the lift arm unit mounted on the supporting portion.

Referring now in greater detail to the drawings wherein the showings are for the purpose of illustrating preferred embodiments of the invention only and not for the purpose of limiting the invention, a wheeled vehicle 10 such as a commercial pick-up truck is shown in FIG. 1 as having the supporting portion 12 of a lift mount assembly mounting on the front end of the vehicle behind the laterally extending vehicle bumper 14. As shown in FIG. 2, and as will be described in greater detail hereinafter, the lift mount assembly further includes a lift arm unit 16 adapted to be removably interconnected with supporting portion 12 so that only the supporting portion need be carried on the vehicle during non-snowplow use thereof, as shown in FIG. 1.

Figure 3:
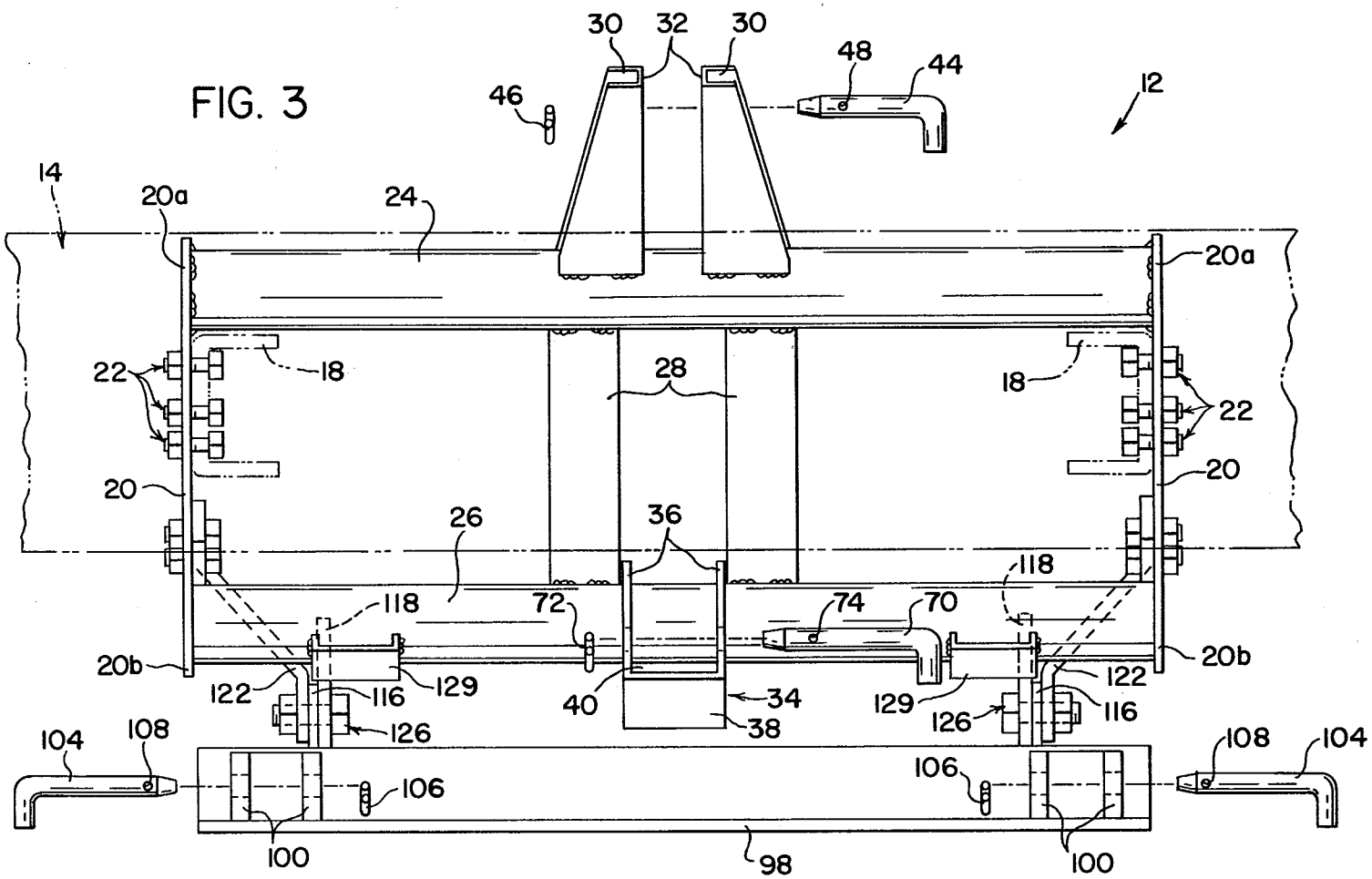
FIG. 3 is a front elevation view of the supporting portion of the assembly.

As seen in FIGS. 2 and 3 of the drawing, vehicle 10 has a pair of laterally spaced apart longitudinally extending frame members 18. Such frame members, generally, are of channel or box construction and have forward ends terminating adjacent the front of the body of the vehicle and to which bumper 14 is suitably attached by bumper mounting supports, not shown. Supporting portion 12 of the lift mount assembly includes a pair of planar mounting plates 20 each securely fastened to a corresponding one of the frame members 18 such as by means of a plurality of nut and bolt assemblies 22. Mounting plates 20 are behind bumper 14 and independent of the bumper mounting supports, and have upper ends 20*a* preferably just below the uppermost surface of bumper 14 and lower ends 20*b* just below the bottom edge of the bumper. An upper cross member 24 extends between mounting plates 20 and has its opposite ends rigidly secured to upper ends 20*a* of the mounting plates such as by welding, and a lower cross member 26 extends between the mounting plates and has its opposite ends rigidly connected with lower ends 20*b* of the mounting plates such as by welding. Cross members 24 and 26 are parallel to one another and, preferably, are of tubular construction and circular in cross-section. This promotes minimizing weight of the supporting portion and thus the overall weight of the lift mount assembly. A pair of tie members in the form of planar straps 28 extend between cross members 24 and 26 and have their upper and lower ends rigidly interconnected therewith such as by welding to restrain relative deflection of the cross members transverse to the axes thereof, as set forth more fully hereinafter. While a pair of straps are shown for this purpose, it will be appreciated that one strap, or more than two can be employed.

Upper cross member 24 is provided intermediate its opposite ends with a pair of upwardly extending and forwardly inclined lift arm mounting members 30 each in the form of a laterally outwardly open channel having its upper end rigidly interconnected with cross member 24 such as by welding. Mounting members 30 are laterally spaced apart for webs 32 thereof to provide opposed parallel walls receiving the inner end of the lift arm member of lift arm unit 16 as described hereinafter. Lower cross member 26 is provided intermediate its opposite ends with a U-shaped bracket member 34 having laterally spaced apart side walls 36 apertured to receive the cross member and rigidly secured thereto such as by welding. Bracket 34 has a bottom wall 38 between side walls 36, and bottom wall 38 has an inner end spaced below the portion of cross member 26 between side walls 36. The side and bottom walls of the bracket extend forwardly beneath vehicle bumper 14 to a point closely adjacent a vertical plane tangent to the forwardmost edge of the bumper. The side walls and bottom wall of bracket 34 and the portion of cross member 26 between the side walls thereof provide a forwardly open socket 40 by which a support arm of lift arm unit 16 is removably interengaged with the supporting portion of the lift mount assembly as described hereinafter.

Lift arm unit 16 includes a lift arm member 42 having inner and outer ends 24*a* and 24*b*, respectively. Inner end 42*a* of the lift arm is disposed between webs 32 of mounting members 30 and is releasably and pivotally interconnected therewith and thus with the upper end of supporting portion 12 of the assembly. Preferably, such interconnection is provided by means of a quick hitch-type L-shaped pin 44 which extends through aligned openings in webs 32 and inner end 42*a* of lift arm 42, and a cotter pin 46 adapted to extend through an opening 48 in hitch pin 44 to releasably hold the latter pin in place. Lift arm unit 16 further includes an extendable and retractable lift arm actuator 50, and an actuator support arm 52 having inner and outer ends 52*a* and 52*b*, respectively. Lift arm actuator 50 has opposite ends with respect to the direction of extension and retraction thereof, one of which ends is pivotally interconnected with outer end 52*b* of support arm 52 and the other with lift arm 42 intermediate inner and outer ends 42*a* and 42*b* thereof. Any suitable extendable and retractable lift arm actuator can be employed, and in the embodiment illustrated, as described more fully hereinafter, lift arm actuator 50 includes a base and body portion 54 pivotally attached to outer end 52*b* of support arm 52 by means of a nut and bolt assembly 56, and a ram member 58 having its outer end pivotally interconnected with lift arm 42 by means of a nut and bolt assembly 60.

Referring in particular to FIG. 2, support arm 52 preferably is a two-piece assembly of interfitting channel members. In this respect, arm 52 includes an upwardly open first U-shaped channel member including a bottom wall 62 and opposed side walls 64, only one of which is seen in the drawing, and a downwardly open second U-shaped channel member providing the support arm with a top wall 66 and downwardly extending sidewalls 68, only one of which is seen in the drawing. Top wall 66 is parallel to bottom wall 62, and each side wall 68 is inwardly adjacent and overlies the corresponding one of the side walls 64 of the first channel member. The bolt of nut and bolt assembly 56 extends through openings in side walls 64 and 68 of support arm 52 to pivotally connect actuator 50 with outer end 52*b* of the support arm, and the support arm is releaseably interengaged with bracket 34 by means of a pin 70. As seen in FIG. 3, pin 70 is a quick hitch-type L-shaped pin, and it will be appreciated that pin 70 extends through aligned openings in bracket walls 36 and walls 64 and 68 of support arm 52. Pin 70 is adapted to receive a cotter pin 72 in opening 74 thereof to releaseably retain pin 70 in place. In the embodiment illustrated, bottom wall 62 and top wall 66 of support arm 52 are spaced apart a distance greater than the spacing between lower cross member 26 and bottom wall 38 of bracket 34. Side walls 68 of the second channel member terminate forwardly of socket 40, and the inner ends of side walls 64 of the first channel member are recessed vertically downwardly as at 76. This provides for inner end 52*a* of the support arm to be slidably received in socket 40 and engaged between bottom wall 38 of bracket 34 and the lower portion of cross member 26 between side walls 36 of the bracket. The forward ends of recesses 76 preferably are contoured to correspond with the cross-sectional contour of cross member 26 such that the recesses provide shoulders abutting against the cross member to position support arm 52 inwardly of socket 40. It will be noted that bottom wall 38 of bracket 34, and thus socket 40, is inclined upwardly and forwardly of cross member 26. Thus, should pin 70 break or otherwise be unintentionally removed during a snowplowing operation, this inclined configuration advantageously promotes retention of arm 52 in socket 40.

It will be noted at this point that the lift mount assembly in its entirety surrounds vehicle bumper 14 independent of any interconnection therewith, and that lift arm mounting members 30 provide for the lift arm to be pivotal about an axis closely adjacent the bumper and for the lift arm to extend outwardly over and closely adjacent the bumper. It will be noted too, that support arm 52 provides for lift arm actuator 50 to be disposed generally vertically in front of and closely adjacent the vehicle bumper, thus providing for the assembly to be quite compact structurally. It will also be appreciated from the foregoing description that lift arm unit 16, as defined by lift arm 42, lift arm actuator 50 and support arm 52, is adapted to be quickly removed as a unit from supporting portion 12 of the assembly simply by removing cotter pins 46 and 72 from hitch pins 44 and 70, and then pulling the latter pins from mounting members 30 and bracket 34. Reassembly of lift arm unit 16 with supporting portion 12 is likewise readily achieved simply by inserting inner end 52*a* of support arm 52 into socket 40, positioning inner end 42*a* of lift arm 42 between mounting members 30, inserting hitch pins 44 and 70, and then providing for retention of the latter by inserting cotter pins 46 and 72 therethrough.

Figure 4:
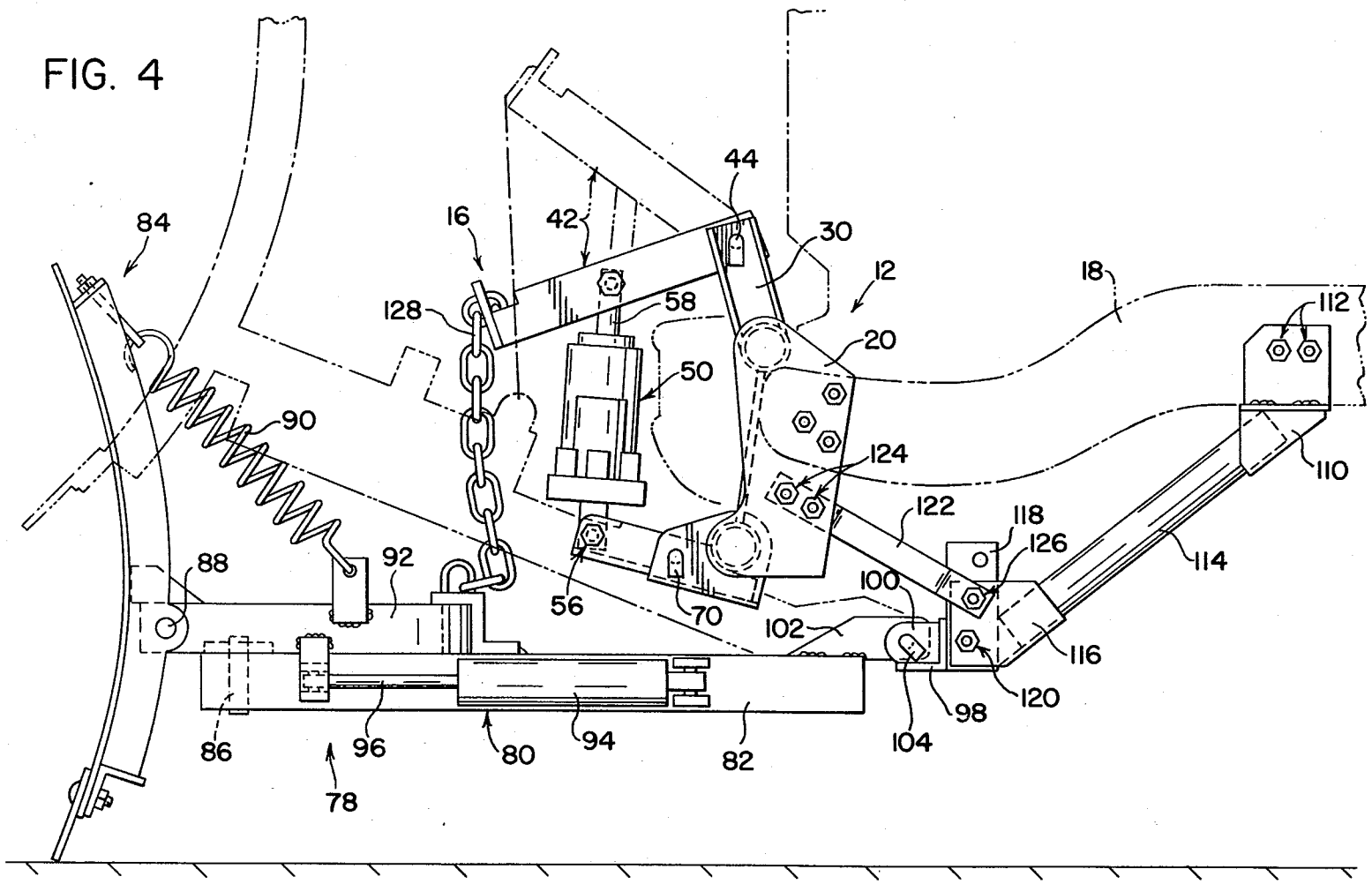
FIG. 4 is a side elevation view of the lift mount assembly showing a snowplow blade unit associated therewith and with supporting structure beneath the vehicle frame.

In FIG. 4 of the drawing, the lift mount assembly is shown in association with a plow blade unit 78. The plow blade unit includes an A-frame 80 comprising a pair of side members 82, only one of which is seen in FIG. 4. A plow blade 84 is supported at the outer end of the A-frame for pivotal movement about a vertical axis by means of a pivot pin 86, and for pivotal movement about a horizontal axis by means of a pivot rod 88. Springs 90 connect the upper rear portion of blade 84 with an arcuate frame portion 92 of the blade unit to maintain a desired position of the blade with respect to pivotal movement thereof relative to the A-frame about the axis of rod 88. Arcuate frame portion 92 supports the blade for pivotal movement about the axis of pin 86, and a hydraulic cylinder 94 and corresponding piston rod 96 are mounted on each of the opposite sides of the A-frame and are interconnected with frame members 82 and arcuate frame portion 92 for pivoting blade 84 in opposite directions with respect to the axis of pin 86. The inner ends of A-frame members 82, and thus the plow blade unit, are pivotally and releasably interconnected with the vehicle frame therebeneath to enable detachment of the blade unit from the vehicle. For this purpose, as best seen in FIGS. 1, 3, and 4, a laterally extending blade unit mounting member 98 is mounted between and beneath vehicle frame members 18 and is provided with laterally spaced apart pairs of clevis members 100. Each pair of clevis members 100 is adapted to receive an inner mounting portion 102 of the corresponding A-frame member 82 therebetween, and the clevis members and mounting portions 102 are provided with aligned openings receiving corresponding quick hitch-type L-shaped pins 104 by which the blade unit is pivotally and releasably interconnected with support member 98. Cotter pins 106 are adapted to be inserted through openings 108 in pins 104 to releasably retain the latter pins in place.

The laterally opposite ends of blade unit support member 98 are interconnected with vehicle frame members 18 by means of corresponding brackets 110 mounted on members 18 such as by nut and bolt assemblies 112, a support strut 114 extending downwardly and forwardly from each bracket 110, and a corresponding lower bracket 116 behind support member 98. Preferably, struts 114 are of tubular construction and the opposite ends thereof are rigidly secured to brackets 110 and 116 such as by welding. The rear side of support member 98 is provided behind clevis members 100 with a vertical plate 118 welded or otherwise rigidly secured to member 98 and by which member 98 is secured to brackets 116 through corresponding nut and bolt assemblies 120. A strap member 122 is secured between each of the brackets 116 and the corresponding mounting plate 20 of supporting portion 12 of the lift mount assembly. In this respect, nut and bolt assemblies 124 interconnect straps 122 with mounting members 20, and nut and bolt assemblies 126 interconnect the straps with brackets 116 and corresponding plate member 118.

While straps 122 are shown as structurally interconnecting the plow blade unit support structure and supporting portion 12 of the lift mount assembly, it should be understood that this arrangement is preferred for purposes of simplicity of construction and mounting with a minimum number of component parts, thus to minimize cost and to facilitate the mounting procedures and time involved therewith. Alternatively, as explained more fully hereinafter, supporting member 98 for the plow blade unit could be interconnected with the vehicle frame members by components similar to straps 122 which would have their outer ends connected directly to the frame members 18 as opposed to the mounting plates 20. Likewise, the lower ends of mounting plates 20 could be directly interconnected with vehicle frame members 18 as opposed to being connected therewith through the blade mounting support.

It will be appreciated from FIG. 4 of the drawing and the foregoing description that actuation of lift arm actuator 50 in the direction to extend ram 58 thereof operates through a link chain 128 connected to the outer end of lift arm 42 to elevate blade unit 78 from the solid line to the broken line position thereon. As best seen in FIGS. 1 and 3, lower cross member 26 is provided with a pair of stops 129 positioned to be engaged by the A-frame during upward movement thereof to protect cross member 26 from damage. When actuator 50 is operated to release ram 58 for retraction, blade unit 78 is lowered back to the solid line position in which it is operable to perform a snow-plowing operation in response to movement of the vehicle relative to the underlining street or the like. When the blade unit is lowered for the latter purpose, cylinders 94 on opposite sides of A-frame 80, and the corresponding rams or piston rods 96, are adapted to be actuated to pivot blade 84 to the left or right about pin 86.

Figure 5:
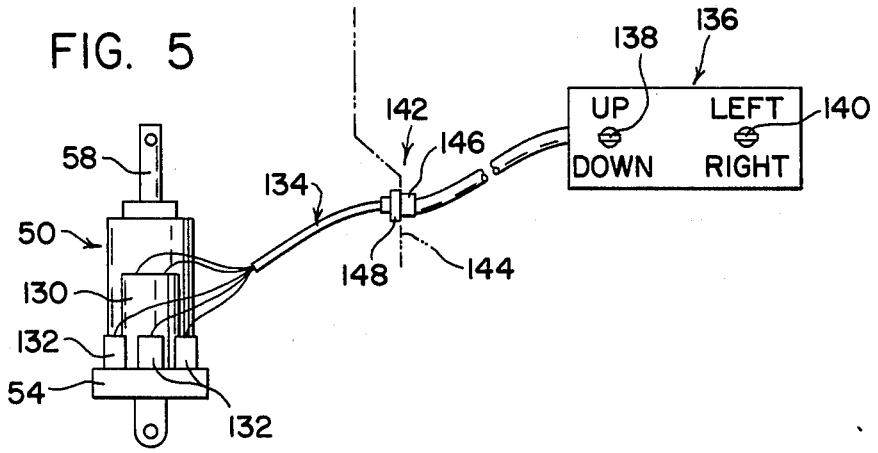
FIG. 5 illustrates a preferred lift arm actuator unit for the assembly.

While any suitable lift arm actuator and controls therefor can be employed in conjunction with lift arm unit 16, lift arm actuator 50 preferably is of the structure and operation illustrated and described in U.S. Pat. No. 3,773,074 to Miceli, the disclosure of which patent is incorporated herein by reference. Briefly, with reference to FIG. 5 showing the actuator in more detail, lift arm actuator 50 as mentioned hereinabove includes a base and body portion 54 and an extendable and retractable ram 58 operable in the foregoing manner to pivot lift arm 42 to achieve lifting and lowering of the plow blade unit. The base and body portion as described in detail in the Miceli patent includes a self contained hydraulic fluid supply for displacing ram 58 thereof and also for displacing the pistons in cylinders 94 to achieve sideways displacement of plow blade 84 relative to A-frame 80. Further in this respect, actuator 50 includes a motor-pump unit 130 including an electric motor for driving the pump, and a plurality of solenoid valves 132 operable to control fluid flow to and from the cylinder for ram 58 and to and from cylinders 94 on the A-frame. The latter flow is through suitable hydraulic connections, not shown, between actuator 50 and cylinders 94. Motor pump unit 130 and solenoids 132 are connected by corresponding electrical power supply lines with a suitable power supply such as the vehicle battery, not shown, through a multiple conductor cable 134, and with a control unit 136 disposed within the vehicle and controllable therefrom by an operator. It will be appreciated that the desired blade movements are achieved in response to appropriate manipulation of control levers 138 and 140 of the control unit.

Figure 6:
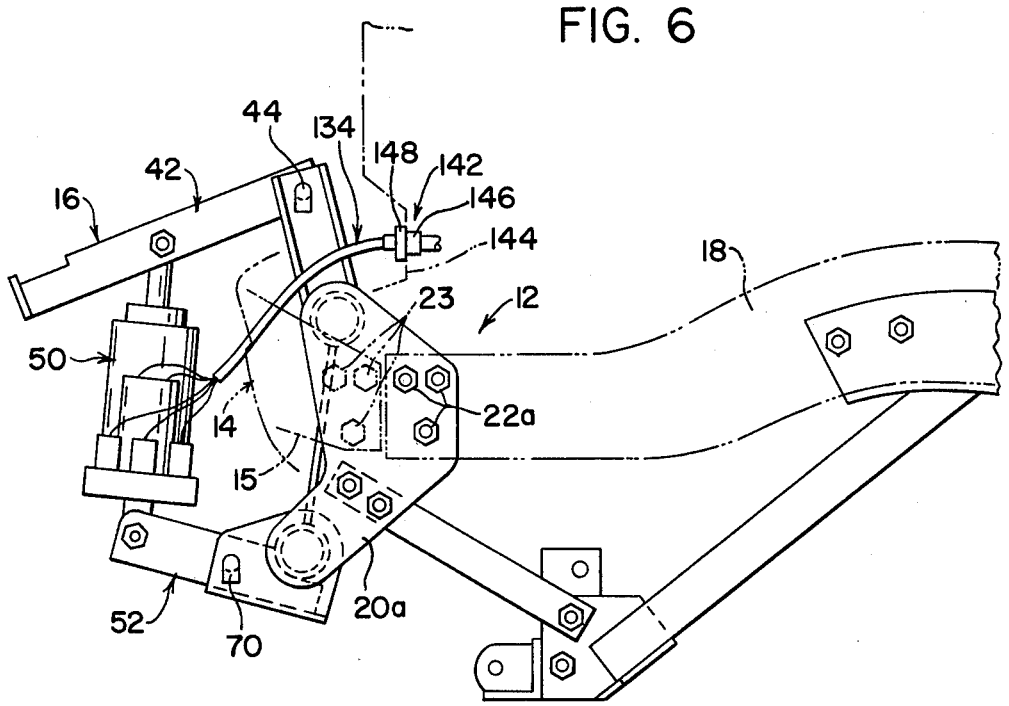
FIG. 6 is a side elevation view of a lift mount assembly illustrating a quick-disconnect arrangement in accordance with the present invention.

In accordance with another aspect in the present invention, as illustrated in FIGS. 5 and 6 of the drawings, the removability of lift arm unit 16 from supporting portion 12 of the lift mount assembly is facilitated by providing a quick-disconnect coupling 142 in power supply line 134 at the point where the power supply line enters the vehicle, such as in grill area 144 of the vehicle body. When the power supply line is defined by electrical wires as in the embodiment illustrated, it will be appreciated that coupling 142 includes detachable male and female coupling components, one of which would be secured to the vehicle body and the other to the portion of the power line extending therefrom to lift arm actuator 50. For purposes of illustration in the embodiment disclosed, for example, coupling 142 includes a female socket component 146 and a male plug component 148. Socket 146 is attached to grill 144 and the wires therefrom lead into the vehicle for connection with the battery and control unit 136, and plug 148 is connected to the power line portion extending from lift arm actuator 50. As will be seen in FIG. 6, coupling 142 facilitates quick removal of lift arm unit 16 from supporting portion 12 of the assembly simply by pulling plug 148 from socket 146 and removing pivot pins 44 and 70 as set forth hereinabove. While such electrical disconnection could be made by individually disconnecting the electrical lines from the motor-pump 130 and solenoids 132, it will be appreciated that the quick-disconnect coupling minimizes the time required to remove the lift arm unit in its entirety from the supporting portion of the assembly, and avoids leaving the power supply lines exposed forwardly of the vehicle during non-snowplow use thereof. Furthermore, while lift arm actuator 50 in the preferred embodiment is a self-contained hydraulic unit whereby the only power lines from the vehicle are electrical lines for actuating the motor and solenoid components thereof, it will be appreciated that the foregoing quick-disconnect relationship would be readily applicable to a lift arm actuator in the form of a hydraulic cylinder and piston assembly in which the power supply therefor would be defined by hydraulic flow lines between the vehicle and cylinder component.

FIG. 6 also illustrates the manner in which the original bumper is retained on a vehicle for aesthetic purposes in a situation in which the bumper is initially mounted too close to the front of the vehicle to enable mounting of the supporting portion of the lift mount assembly behind the bumper as desired in accordance with the present invention. In this respect, FIG. 6 schematically illustrates bumper 14 as having mounting straps 15, and illustrates support plate member **20*a* as being mounted on vehicle frame member 18 by means of a plurality of nut and bolt assemblies 22*a*. The openings in frame member 18 for nut and bolt assemblies 22*a* are the openings for nut and bolt assemblies initially used to mount bumper 14 on the vehicle by means of mounting straps 15, and side plate member 20*a* is provided with openings by which bumper 14 is mounted on the vehicle through the side plate members by means of nut and bolt assemblies 23 extending through the openings in the side plate members and the original openings in bumper straps 15**. Accordingly, it will be appreciated that the original bumper of the vehicle is simply relocated a short distance forwardly of its original position, thus retaining the aesthetic value thereof and without requiring any major modification of the bumper or its mounting arrangement.

Figure 7:
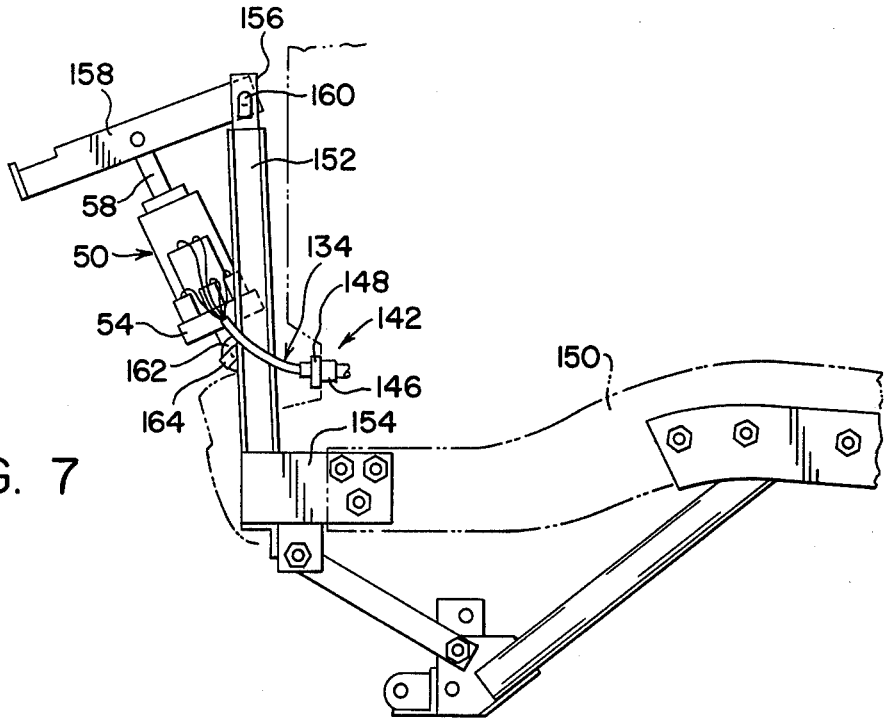
FIG. 7 is a side elevation view illustrating a quick-disconnect arrangement in association with another lift frame assembly.

While the lift mount assembly of the present invention advantageously surrounds the vehicle bumper as described hereinabove, it will be appreciated that the quick-disconnect aspect of the invention with respect to the lift arm unit and the power supply for the lift arm actuator is applicable to other lift mount assembly structure, such as that shown in FIG. 7 for example. More particularly in this respect, FIG. 7 illustrates a lift mount assembly similar to that shown in U.S. Pat. No. 3,706,144 and, in this respect, includes a lift arm mounting member 152 which when viewed from the front of the vehicle is of inverted U-shaped configuration. The lower ends of member 152 are suitably interconnected with vehicle frame members 150 such as by mounting plates 154. The upper end of mounting member 152 is provided with a pair of laterally spaced apart plates 156 receiving the inner end of lift arm 158 therebetween, and arm 158 is pivotally and releasably interconnected therewith by a quick-disconnect hitch-type pin assembly including a pin 160 corresponding to hitch-type pins 44 and 70 described hereinabove. Lift arm actuator 50 has the outer end of ram member 58 thereof pivotally interconnected with lift arm 158 intermediate the inner and outer ends thereof. Further, base and body portion 54 of the actuator is pivotally and releasably interconnected with the supporting portion of the assembly by means of a laterally spaced apart pair of mounting arms 162 rigidly secured to the supporting portion and a quick-disconnect hitch-type pin assembly including a hitch-type pin 164 corresponding to hitch-type pins 44 and 70. Furthermore, lift arm actuator 50 includes a multiple conductor power line 134, as described hereinabove in connection with FIG. 5, and a quick-disconnect coupling 142 including a socket component 146 attached to the vehicle body and a plug component 148 attached to the power line portion leading to actuator 50. Thus, the lift arm unit as defined by lift arm 158 and lift arm actuator 50 is readily removable from the supporting structure therefor simply by separating coupling components 146 and 148 and removing hitch pins 160 and 164.

Figure 8:
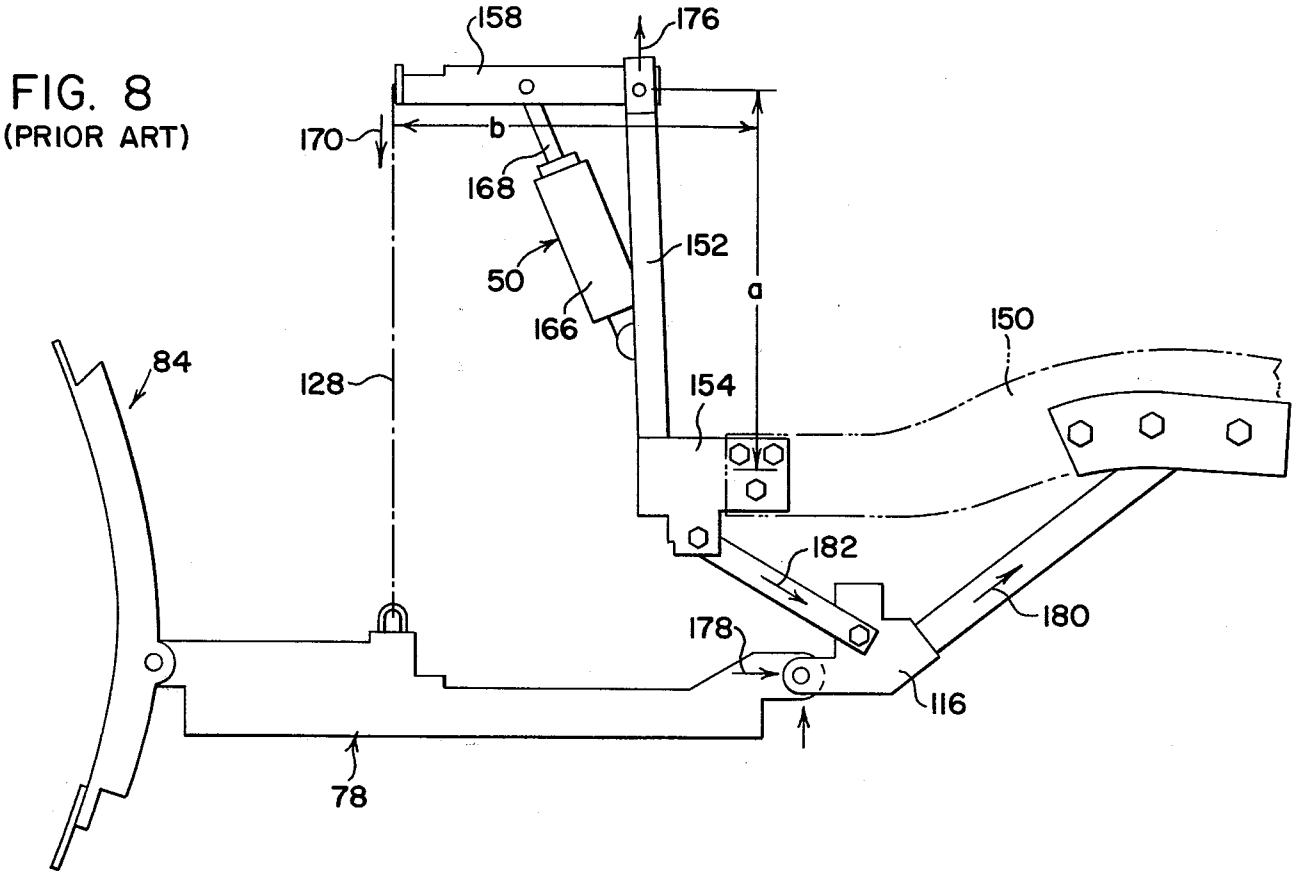
FIG. 8 (PRIOR ART)
FIG. 8 is a side elevation view, partially schematic, of a prior art lift mount assembly and plow blade unit illustrating dimensional relationships between various component parts thereof; and, FIG. 9 is a side elevation view, partially schematic, of a lift mount assembly according to the present invention illustrating dimensional relationships between component parts thereof.

As mentioned herein, a lift mount assembly in accordance with the present invention enables a considerable reduction in weight and an improved distribution and application of forces to the component parts of the assembly and the mounting connections thereof with the vehicle frame members. To facilitate a better understanding of these improvements, FIGS. 8 and 9 of the drawing somewhat schematically illustrate structural and dimensional relationships between the component parts of a prior art arrangement and an arrangement according to the present invention, respectively. In FIG. 8 the component parts of the lift arm assembly correspond to that shown in FIG. 7, except that the lift arm actuator 50 in FIG. 8 is in the form of a simple hydraulic piston and cylinder assembly including a cylinder 166 having its lower end pivotally connected to lift arm mounting member 152, and a piston rod 168 having its outer end pivotally interconnected with lift arm 158. Futher, the lift mount assembly in FIG. 8 is shown in association with a plow blade unit 78 corresponding to the plow blade unit described hereinabove in connection with FIG. 4 of the drawing. The lift mount assembly and plow blade unit shown in FIG. 9 corresponds with that of FIG. 4, except that lift arm actuator 50, as in FIG. 8, is illustrated as a simple piston and cylinder assembly including cylinder member 166 having its lower end pivotally connected with the outer end of support arm 52, and piston rod 168 having its outer end pivotally interconnected with lift arm 42. Accordingly, other than for the foregoing exceptions, like numerals are employed in FIGS. 7 and 8 to identify corresponding parts and in FIGS. 4 and 9 for the same purpose.

Figure 9:
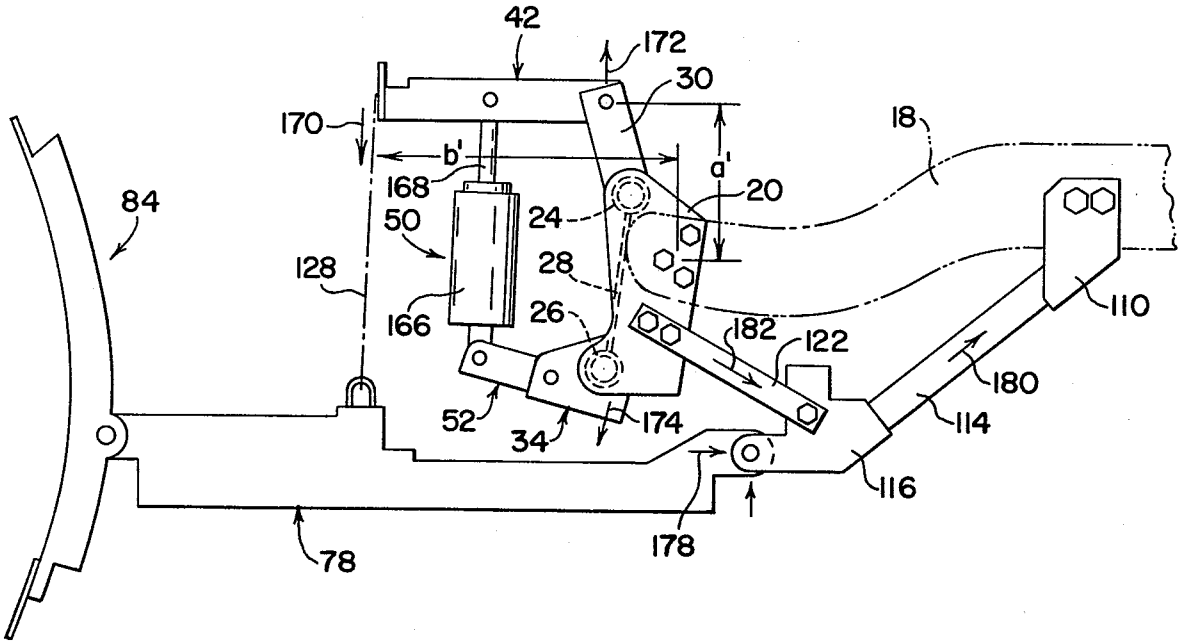

With the foregoing in mind, it will be seen from FIGS. 8 and 9 that the vertical distance between the points of pivotal connection of the lift arms with the lift arm mounting members and the effective points of connection of the latter with the vehicle frame members is respectively indicated by letters a and a'. Likewise, it will be seen that the horizontal distance between the outer ends of the lift arms and the points of connection of the lift arm mounting members with the vehicle frame is indicated by letters b and b', respectively. It will be noted that while the distances b and b' are about the time, the distance a' is considerably less than the distance a. When the lift arm actuators 50 are operated to displace the corresponding lift arms upwardly so as to elevate plow blade 84 of plow blade unit 78 from the ground, the weight of the plow blade unit is applied to the outer ends of the lift arms as indicated by arrows 170 in FIGS. 8 and 9. It will be apparent from a comparison of the two figures that the torsional forces imposed on the connection between the lift arms and mounting plates and between the latter and the frame members as a result of the weight of the respective plow blade units is considerably greater in the prior art arrangement of FIG. 8 as a result of the length of dimension a. It will be appreciated therefore that the torsional forces in the assembly shown in FIG. 8 necessitate a structurally heavier lift arm mounting member 152 and mounting plates 154 therefor, as well as a stronger structural interconnection between the mounting member and plates, such as by increased weldments for example. It will be further appreciated that these requirements, together with the vertical length of mounting member 152 add considerably to the weight of the lift mount assembly. In comparison, the structure of the supporting portion of the lift mount assembly in accordance with the present invention, as seen in FIG. 9, advantageously enables the lift arm mounting members 30 to be quite short in comparison with mounting arm 152. Accordingly, the reduction of dimension a' in comparison with dimension a, and the resulting reduction in torsional forces imposed on the connections between mounting plates 20 and frame members 18, enables the use of structurally lighter component parts and thus a structurally light lift mount assembly. Further, with respect to promoting weight reduction, the structure of the supporting portion of the lift mount assembly according to the present invention enables the use of tubular constructions for cross members 24 and 26 with tie straps 28 therebetween, and this structure and structural interrelationship between the cross members provides the necessary structural integrity while reducing the weight which would result from the size and/or cross-section of solid cross members which would be required to provide the necessary structural integrity. With further regard to tubular cross members 24 and 26 and the tie straps 28, it will be appreciated that the weight of plow blade unit 78 on the outer end of lift arm 42 imposes a force on lift arm mounting members 30 in the direction of arrow 172 in FIG. 9 and a force in the opposite direction on support bracket 34 as indicated by arrow 174. Thus, forces are applied to cross members 24 and 26 in the directions of arrows 172 and 174, respectively, and deflections of tubular cross members 24 and 26 in response thereto is restrained by tie scraps 28. To optimize the function of straps 28, they are preferably laterally associated with cross members 24 and 26 as illustrated in FIG. 3 of the drawing and, in this respect, have their lower ends closely adjacent the laterally opposite sides of bracket 34 and their upper ends underlying a corresponding one of the lift arm mounting members 30.

With further regard to FIGS. 8 and 9, it will be noted that lift arm actuator 50 in FIG. 8 defines one leg of a triangle with lift arm mounting member 152 and lift arm 158, and is at an angle with respect to the direction of force applied to the pivotal connection between mounting member 152 and lift arm 158, as indicated by arrow 176. In comparison, lift arm actuator 50 in the arrangement shown in FIG. 9 is generally vertical and parallel with respect to the direction of force applied at pivotal connection between lift arm 42 and lift arm mounting members 30 as indicated by arrow 172. Thus, the force on lift arm actuator 50 in FIG. 9 resulting from the weight of plow blade unit 78 is applied generally axially of cylinder 166 and piston rod 168, thus to improve the mechanical advantage in connection with elevating the plow blade unit, and to minimize the wear between the relatively slidible component parts of the lift arm actuator during elevation and lowering of the plow blade unit and during the transport of the plow blade unit in the elevated position thereof.

As also mentioned hereinabove, when plow blade unit 78 is lowered into engagement with a roadway or the like during a snowplowing operation, the plowing forces are applied generally horizontally to the plow blade mounting structure supported beneath the vehicle frame by brackets 116, and thence to the vehicle frame members through support members 114 between brackets 116 and brackets 110, as indicated by arrows 178 and 180 in FIGS. 8 and 9. When the blade unit is either in the elevated or the lowered position thereof, a force is transmitted to bracket 116 through straps 122, in the direction of arrows 182, and thence to the vehicle frame members in the direction of arrows 180. When the plow blade unit is elevated the latter force is compressive and results from the weight of the lift mount assembly and plow blade unit. When the blade is lowered the compression force results only from the weight of the lift mount assembly and is opposed by a tensional force resulting from the plowing operation. Accordingly, it will be appreciated that the forces imposed on the lift mount assembly and vehicle frame members when the plow blade unit is elevated are practically independent of the forces imposed on the plow blade unit support and vehicle frame members during a snowplowing operation. Thus, as mentioned hereinabove, straps could be employed to directly interconnect brackets 116 with the vehicle frame members, and separate straps could be employed to directly interconnect mounting plates 20 with the frame members. Straps 122 between mounting plates 20 and brackets 116 are preferred in that they simplify the structure and installation and provide a convenient structural interrelationship between the lift mount assembly and plow blade unit.

While considerable emphasis has been placed on the specific structure of the lift mount assembly illustrated and described herein and the structural interrelationship between the component parts thereof and between the assembly and the vehicle on which it is mounted, it will be appreciated that many embodiments of the invention can be made and many changes can be made in the embodiments herein disclosed without departing from the principles of the present invention. In this respect, for example, the cross-sectional configuration of the tubular cross members of the supporting portion of the assembly could be other than circular, and the cross members could be other than of tubular construction if appropriately supported against deflection either by the cross-sectional configuration and/or dimension thereof and/or an appropriate tying interconnection therebetween. Further, it will be appreciated that arrangements other than the bracket and lower cross member socket structure herein described can be employed to receive the inner end of the lift arm actuator support arm to removably support the latter with respect to the supporting portion of the assembly. In this respect, for example, the bracket on the lower cross member could itself be structured to provide the forwardly open socket for the inner end of the support arm, and the arrangement for positioning the inner end of the support arm relative to such socket or to a socket defined in part by the lower cross member could be provided other than by contouring the inner end of the support arm for engagement with the cross member. These and other changes in the embodiments herein illustrated and described, as well as other embodiments of the invention, will be obvious or suggested to those skilled in the art upon reading and understanding the specifications. Accordingly, it is to be distinctly understood that the foregoing descriptive matter is to be interrupted merely as a lessertive of the present invention and not as a limitation.

We claim:

1. A plow blade lift mount assembly mountable on the front of a vehicle including longitudinally extending vehicle frame members having front ends and laterally extending bumper means at said front ends of said frame members, comprising support means mounted on said frame members behind said bumper means and having upper and lower ends with respect thereto, lift arm means pivotally interconnected with said upper end of said support means and extending forwardly over said bumper means, support arms means on said lower end of said support means and extending forwardly below said bumper means, extendable and retractable lift arm actuating means forwardly of said bumper means and having opposite ends pivotally interconnected one with said support arm means and the other with said lift arm means, fastening means releasably connecting said support arm means with said support means, and removable pivot pin means pivotally interconnecting said lift arm means and said support means, said fastening means and pivot pin means being located behind a vertical plane tangent to the forwardmost edge of said bumper means.

2. A plow blade lift mount assembly mountable on the front of a vehicle including longitudinally extending vehicle frame members having front ends and laterally extending bumper means at said front ends of said frame members, comprising support means mounted on said frame members behind said bumper means and having upper and lower ends with respect thereto, lift arm means pivotally interconnected with said upper end of said support means and extending forwardly over said bumper means, support arm means on said lower end of said support means and extending forwardly below said bumper means, extendable and retractable lift arm actuating means forwardly of said bumper means and having opposite ends pivotally interconnected one with said support arm means and the other with said lift arm means, and means releasably interengaging said lift arm means and said support arm means with said support means for removal of said lift arm means, support arm means and actuator means as a unit from said support means, said support means having a forwardmost projection closely adjacent a vertical plane tangent to the forwardmost edge of said bumper means.

3. A plow blade lift mount assembly mountable on the front of a vehicle including longitudinally extending vehicle frame members having front ends and laterally extending bumper means at said front ends of said frame members, comprising support means mounted on said frame members behind said bumper means and having upper and lower ends with respect thereto, lift arm means pivotally interconnected with said upper end of said support means and extending forwardly over said bumper means, support arm means on said lower end of said support means and extending forwardly below said bumper means, extendable and retractable lift arm actuating means forwardly of said bumper means and having opposite ends pivotally interconnected one with said support arm means and the other with said lift arm means, said support means including a mounting plate on each of said vehicle frame members, said mounting plates having upper and lower ends, and laterally extending upper and lower cross members respectively interconnecting said upper and lower ends of said mounting plates, said lift arm means being pivotally interconnected with said upper cross member centrally between said mounting plates, and said support arm means being on said lower cross member centrally between said mounting plates.

4. The assembly according to claim 3, wherein said upper cross member is below a horizontal plane tangent to the uppermost edge of said bumper means.

5. The assembly according to claim 3, and tie member means interconnecting said upper and lower cross members laterally inwardly of said mounting plates.

6. The assembly according to claim 3, wherein said cross members are tubular.

7. The assembly according to claim 6, and bracket means mounted on said lower cross member laterally centrally thereof, said bracket means having laterally spaced apart side walls and a bottom wall therebetween and spaced below said lower cross member, said support arm means having an inner end received between said side walls and between said bottom wall and said lower cross member, and means releasably interengaging said support arm means and said bracket means.

8. The assembly according to claim 7, wherein said means releaseably interengaging said support arm means and bracket means includes pin means extending through openings in said side walls and said support arm means.

9. The assembly according to claim 8, wherein said bottom wall of said bracket means extends forwardly and upwardly with respect to said lower cross member.

10. The assembly according to claim 7, and lift arm mounting member means on said upper cross member and extending upwardly therefrom, said mounting member means including laterally spaced apart side walls, said lift arm means having an inner end received between said side walls of said mounting member means, and removable pivot pin means extending through openings in said side walls of said mounting member means and said inner end of said lift arm means for releasably and pivotally interconnecting said lift arm means with said mounting member means.

11. The assembly according to claim 10, and a pair of strap members between and interconnecting said tubular cross members, said strap members being laterally spaced apart, and said bracket means being between said strap members.

12. The assembly according to claim 11, wherein said upper cross member is below a horizontal plane tangent to the uppermost edge of said bumper means.

13. The assembly according to claim 6, and lift arm mounting member means on said upper cross member and extending upwardly therefrom, said mounting member means including laterally spaced apart side walls, said lift arm means having an inner end received between said side walls of said mounting member means, and removable pivot pin means extending through openings in said side walls of said mounting member means and said inner end of said lift arm means for releaseably and pivotally interconnecting said lift arm means with said mounting member means.

14. The assembly according to claim 13, wherein said upper cross member is below a horizontal plane tangent to the uppermost edge of said bumper means.

15. The assembly according to claim 14, and a pair of strap members spaced laterally inwardly of said mounting plates and each having upper and lower ends respectively interconnected with said upper and lower cross members.

16. The assembly according to claim 6, wherein said support means further includes support arm bracket means on said lower cross member laterally centrally thereof and extending forwardly thereof, and lift arm mounting member means on said upper cross member laterally centrally thereof and extending upwardly therefrom, said mounting member means being behind a vertical plane tangent to the forwardmost edge of said bumper means, and said bracket means having an outer end closely adjacent said plane.

17. The assembly according to claim 16, wherein said upper cross member is below a horizontal plane tangent to the uppermost edge of said bumper means.

18. The assembly according to claim 16, and further including first removable pin means releaseably interconnecting said support arm means with said bracket means, and second removable pin means releasably and pivotally interconnecting said lift arm means with said lift arm mounting member means, removal of said first and second pin means releasing said support arm means, lift arm means and lift arm actuating means for removal as a unit from said support means.

19. The assembly according to claim 18, and tie member means interconnecting said upper and lower cross members laterally inwardly of said mounting plates.

20. The assembly according to claim 19, wherein said upper cross member is below a horizontal plane tangent to the uppermost edge of said bumper means.

21. The assembly according to claim 18, wherein said bracket means and lower cross member provide a forwardly and upwardly inclined socket receiving said support arm means.

22. A plow blade lift mount assembly mountable on the front of a vehicle having laterally spaced apart vehicle frame members, comprising mounting member means adapted to be mounted on said vehicle frame members and each having upper and lower ends, upper and lower support means respectively interconnecting said upper and lower ends of said mounting member means, lift arm means having an inner end pivotally interconnected with said upper support means and having an outer end forwardly thereof, said lower support means including means providing a forwardly open socket having upper and lower walls, support arm means having an inner end received in said socket between said upper and lower walls and having an outer end forwardly of said lower support means, means to releasably retain said inner end of said support arm means in said socket, and extendable and retractable lift arm actuating means having opposite ends interconnected one with said outer end of said support arm means and the other with said lift arm means between said inner and outer ends thereof.

23. The assembly according to claim 22, wherein said socket extends forwardly and upwardly with respect to said lower support means.

24. The assembly according to claim 22, wherein said lower support means includes a cross member between said mounting member means and bracket means mounted on said cross member, said bracket means having a bottom wall spaced below said cross member and laterally spaced apart side walls, said bracket means and cross member providing said socket and said bottom wall of said bracket means and the portion of said cross member thereabove respectively providing said lower and upper walls of said socket.

25. The assembly according to claim 24, wherein said inner end of said support arm means includes means engaging said cross member to limit movement of said support arm means inward of said socket.

26. The assembly according to claim 25, wherein said cross member is circular in cross section and said inner end of said support arm means is contoured to provide a portion extending under said cross member and an arcuate shoulder forwardly of said portion engaging against said cross member to limit inward movement of said support arm means.

27. The assembly according to claim 24, wherein said means to releasably retain said inner end of said support arm means in said socket includes removable pin means extending through openings in said side walls of said bracket means and said support arm means.

28. The assembly according to claim 27, wherein said bottom wall of said bracket means extends forwardly and upwardly with respect to said lower cross member.

29. The assembly according to claim 28, wherein said inner end of said support arm means includes means engaging said cross member to limit movement of said support arm means inward of said socket.

30. The assembly according to claim 29, wherein said cross member is circular in cross section and said inner end of said support arm means is contoured to provide a portion extending under said cross member and an arcuate shoulder forwardly of said portion engaging against said cross member to limit inward movement of said support arm means.

31. The assembly according to claim 30, wherein said upper support means includes a cross member spaced above and parallel to said cross member of said lower support means, each cross member being a tube of circular cross section, and strap means between and interconnecting said cross members against relative deflection transverse to the axes thereof.

32. The assembly according to claim 31, wherein said strap means includes a pair of planar strap members parallel to the axes of said cross members.

33. The assembly according to claim 32, wherein said upper support means further includes lift arm mounting member means on said upper cross member and extending upwardly therefrom and having an upper end, and removable pin means releaseably and pivotally interconnecting said inner end of said lift arm means with said upper end of said lift arm mounting member means.

* * * * *